US005853315A

United States Patent [19]

Satoh

[11] Patent Number: 5,853,315

[45] Date of Patent: Dec. 29, 1998

[54] SOUND GENERATING TOY

[75] Inventor: Ryouichi Satoh, Matsudo, Japan

[73] Assignee: Takara Co., Ltd., Tokyo, Japan

[21] Appl. No.: 913,131

[22] PCT Filed: Jan. 6, 1997

[86] PCT No.: PCT/JP97/00004

§ 371 Date: Sep. 8, 1997

§ 102(e) Date: Sep. 8, 1997

[87] PCT Pub. No.: WO97/25120

PCT Pub. Date: Jul. 17, 1997

[30] Foreign Application Priority Data

Jan. 8, 1996 [JP] Japan ..... 8-018116

[51] Int. Cl.[6] ..... A63H 3/28; A63H 3/24

[52] U.S. Cl. ..... 446/301; 446/304; 446/420

[58] Field of Search ..... 446/297, 298, 446/301, 304, 305, 337–340, 353, 420, 418

[56] References Cited

U.S. PATENT DOCUMENTS

| | | | |
|---|---|---|---|
| 2,631,408 | 3/1953 | Henry | 446/304 |
| 4,979,925 | 12/1990 | Bergersen | 446/297 |
| 5,250,003 | 10/1993 | Ferre | 446/301 |

FOREIGN PATENT DOCUMENTS

| | | |
|---|---|---|
| 54-135920 | 9/1979 | Japan . |
| 59-68588 | 5/1984 | Japan . |
| 61-148390 | 9/1986 | Japan . |
| 562296 | 8/1993 | Japan . |
| 3001611 | 6/1994 | Japan . |

*Primary Examiner*—Mickey Yu
*Attorney, Agent, or Firm*—Price, Gess & Ubell

[57] ABSTRACT

A sound generating toy capable of generating sound without any power supply and while being simplified in structure, as well as exhibiting more reality. The toy includes a toy body including a head, in which a mouth (4), a door member (5) pivotally moved when the mouth is charged with a toy food (3), a spiral spring wind-up mechanism (6) actuated in association with the door member, a spiral spring unit (7) and a sound output unit (A) are arranged. When an eccentric rotating member (15) mounted on an output shaft (14) of the spiral spring unit is rotated to engage with a sound generating means (8), the sound generating means cyclically generates sound.

20 Claims, 4 Drawing Sheets

SOUND GENERATING TOY

TECHNICAL FIELD

This invention relates to a sound generating toy, and more particularly to a sound generating toy adapted to generate sound when a toy food made in imitation of food is put in a mouth thereof.

BACKGROUND ART

A conventional sound generating toy is generally constructed so that a switch or sensor suitably arranged on a toy body of the toy detects vibration or sound to actuate a sound generating unit such as a sound synthesizing IC or the like arranged in the toy body, to thereby generate sound.

Unfortunately, the conventional sound generating toy requires a power supply for actuating the sound generating unit, to thereby require frequent replacement of exhausted batteries or cells, resulting in a maintenance fee of the toy being significantly increased. Also, exhaustion of the power supply leads to interruption of operation of the toy.

The present invention has been made in view of the foregoing disadvantage of the prior art. Accordingly, it is an object of the present invention to provide a sound generating toy which is capable of generating effective sound while being simplified in structure and without requiring any specific power supply.

It is another object of the present invention to provide a sound generating toy which is capable of exhibiting increased reality.

DISCLOSURE OF INVENTION

In accordance with the present invention, a sound generating toy is provided. The sound generating toy includes a toy body provided with a head and a mouth arranged in the head, wherein sound is generated when a toy food is put in the mouth. The toy further includes a door member arranged in the head so as to be moved when a toy food made in imitation of food is put in the mouth, a spiral spring unit including a spiral spring, an input shaft and an output shaft and arranged in the head, a wind-up mechanism arranged in the head and actuated in association with the door member to wind up the spiral spring of the spiral spring unit, and a sound generating means arranged in the head for generating sound. The output shaft of the spiral spring unit is mounted thereon with an eccentric rotation member, so that rotation of the output shaft causes the eccentric rotation member to engage with the sound generating means to permit the sound generating means to mechanically and cyclically generate sound.

A sound generating toy in accordance with the present invention generates sound of increased reality while being simplified in structure. Also, it generates sound without requiring any battery as a power source, to thereby be played with at any time and anywhere as desired. Furthermore, it never produces any exhausted batteries as waste, and thus it is friendly to the environment.

In a preferred embodiment of the present invention, the toy further includes a lower jaw member pivotally arranged in the mouth and a lever operatively connected to the lower jaw member to vertically pivotally move the lower jaw member, wherein the output shaft of the spiral spring unit is mounted thereon with an eccentric cam and the cam is engaged with the lever. Such construction permits the lower jaw member to be actuated in synchronism with generation of sound from beginning to end, to thereby exhibit more increased reality.

In a preferred embodiment of the present invention, the door member is arranged in a manner to be pivotally movable, the wind-up mechanism comprises a sector gear provided on the door member, the input shaft of the spiral spring unit is mounted thereon with a wind-up gear, and the sector gear is engaged with the wind-up gear.

In a preferred embodiment of the present invention, the toy body is formed therein with a passage for transferring the toy food therethrough in a manner to extend from the mouth to a rear portion of the toy body, the passage has an opening formed at the rear portion of the toy body, and the rear portion of the toy body is provided with a receptacle section for covering the opening of the passage and receiving the toy food.

In a preferred embodiment of the present invention, the sound generating means comprises a stretchedly arranged coiled spring and a speaker arranged so as to be in contact with the coiled spring, wherein the eccentric rotation member is formed on an outer periphery thereof with unevenness engageable with the coiled spring, the unevenness generates a vibrational sound due to engagement thereof with the coiled spring and movement thereof relative to the coiled spring, and the vibrational sound is transmitted to the speaker, resulting in its being amplified.

In a preferred embodiment of the present invention, the speaker comprises a cone member fixed on a cantilevered support member.

In a preferred embodiment of the present invention, the coiled spring is held at one end thereof on the support member.

In a preferred embodiment of the present invention, the speaker includes a detection element arranged on the support member so as to be in contact at one end thereof with an outer surface of the coiled spring.

In a preferred embodiment of the present invention, the toy body has an appearance formed in imitation of an animal and the receptacle section is formed in imitation of a rucksack.

BEST MODE FOR CARRYING OUT THE INVENTION

Now, a sound generating toy according to the present invention will be described hereinafter with reference to the accompanying drawings.

Figure 1:
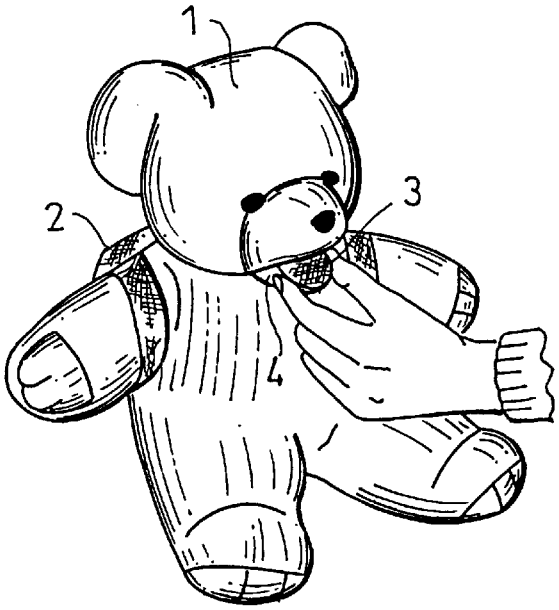
FIG. 1 is a schematic perspective view generally showing an embodiment of a sound generating toy according to the present invention.
Figure 2:
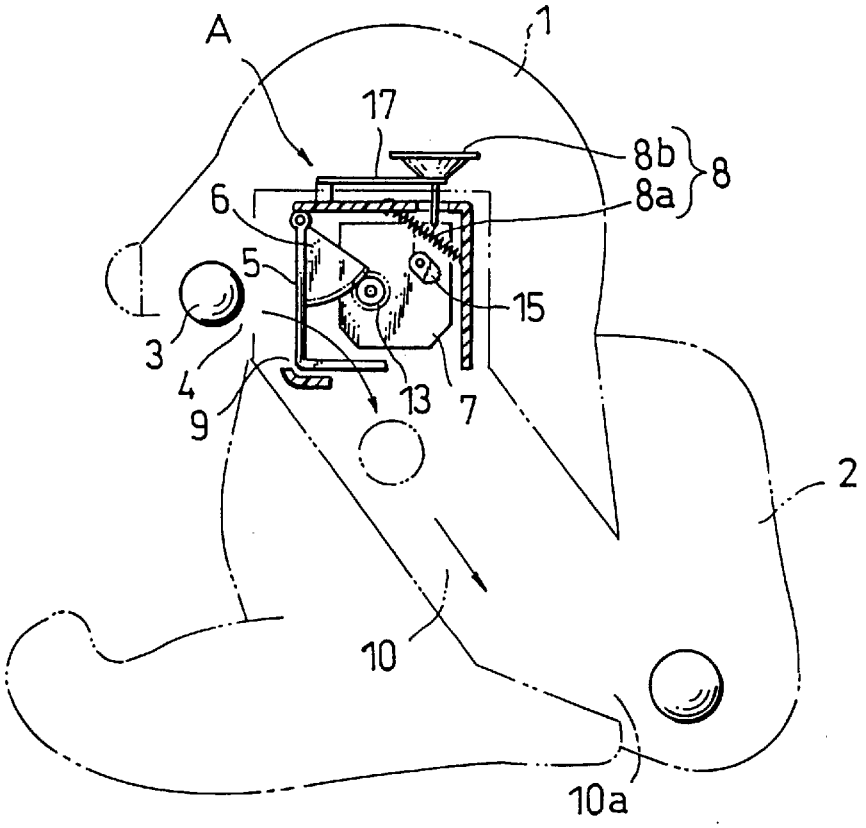
FIG. 2 is a partly sectional view showing an essential part of the sound generating toy of FIG. 1.

Referring first to FIGS. 1 to 4, an embodiment of a sound generating toy according to the present invention is illustrated. A sound generating toy of the illustrated embodiment is formed in imitation of a little bear having a receptacle section in the form of a rucksack 2 carried on a back thereof and constructed so as to generate sound when a toy food 3 made in imitation of food is put in a mouth 4 of the toy. The toy has a toy body including a head 1, which, as shown in FIG. 2, is provided therein with a door member 5 in a manner to be pivotally movable so that the toy food 3 put in the mouth 4 forces the door member 5 to pivotally move it. Also, the head 1 is provided therein with a spiral spring wind-up mechanism 6 actuated in association with the door member 5, a spiral spring unit 7 having a spiral spring wound up by the wind-up mechanism 6, and a sound generating means 8 including a coiled spring 8*a* stretchedly arranged and a speaker 8*b*. The door member 5, wind-up mechanism 6, spiral spring unit 7 and sound generating means 8 cooperate with each other to provide a sound output unit A.

The sound output unit A is formed with a box-like shape having the front side and bottom side thereof opened and arranged in an upper portion of a passage 10 of a rectangular cylindrical shape defined in the toy body so as to obliquely extend from the head 1 of the toy body to the back thereof. The passage 10 is formed so as to communicate at one end thereof with the mouth 4 and at the other end thereof with an interior of the rucksack 2, resulting in the toy food 3 charged in the mouth 4 being guided through the passage 10 to the rucksack 2.

Figure 3A:
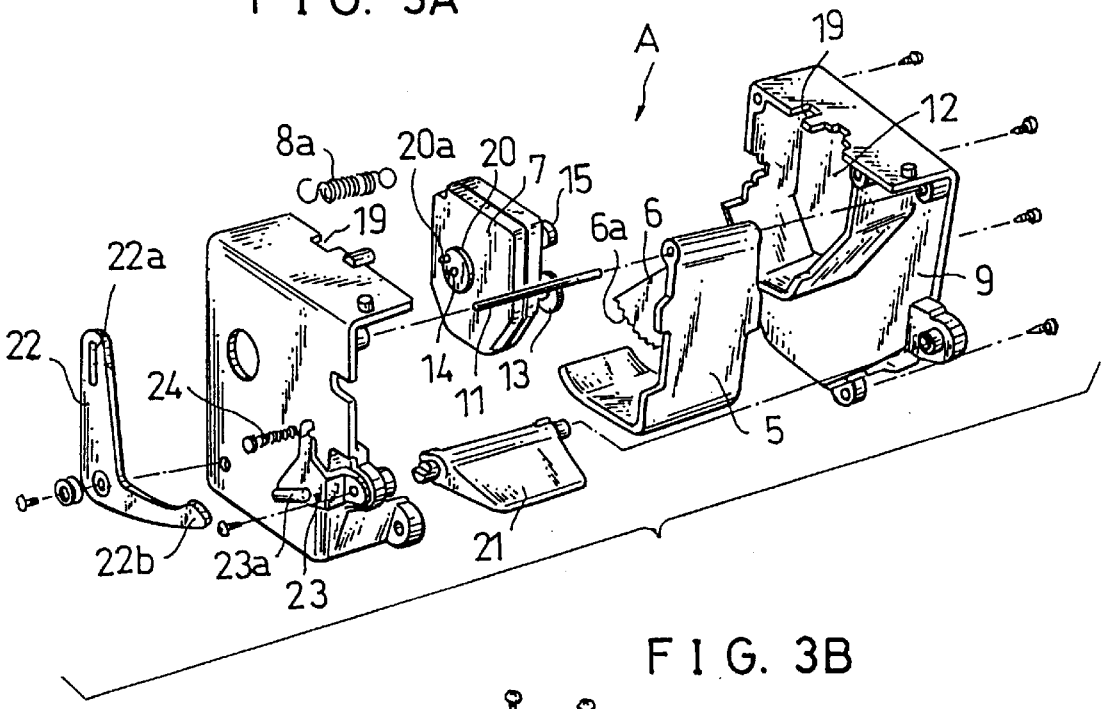
FIGS. 3A and 3B each are an exploded perspective view showing an internal structure of the sound generating toy of FIG. 1.
Figure 3B:
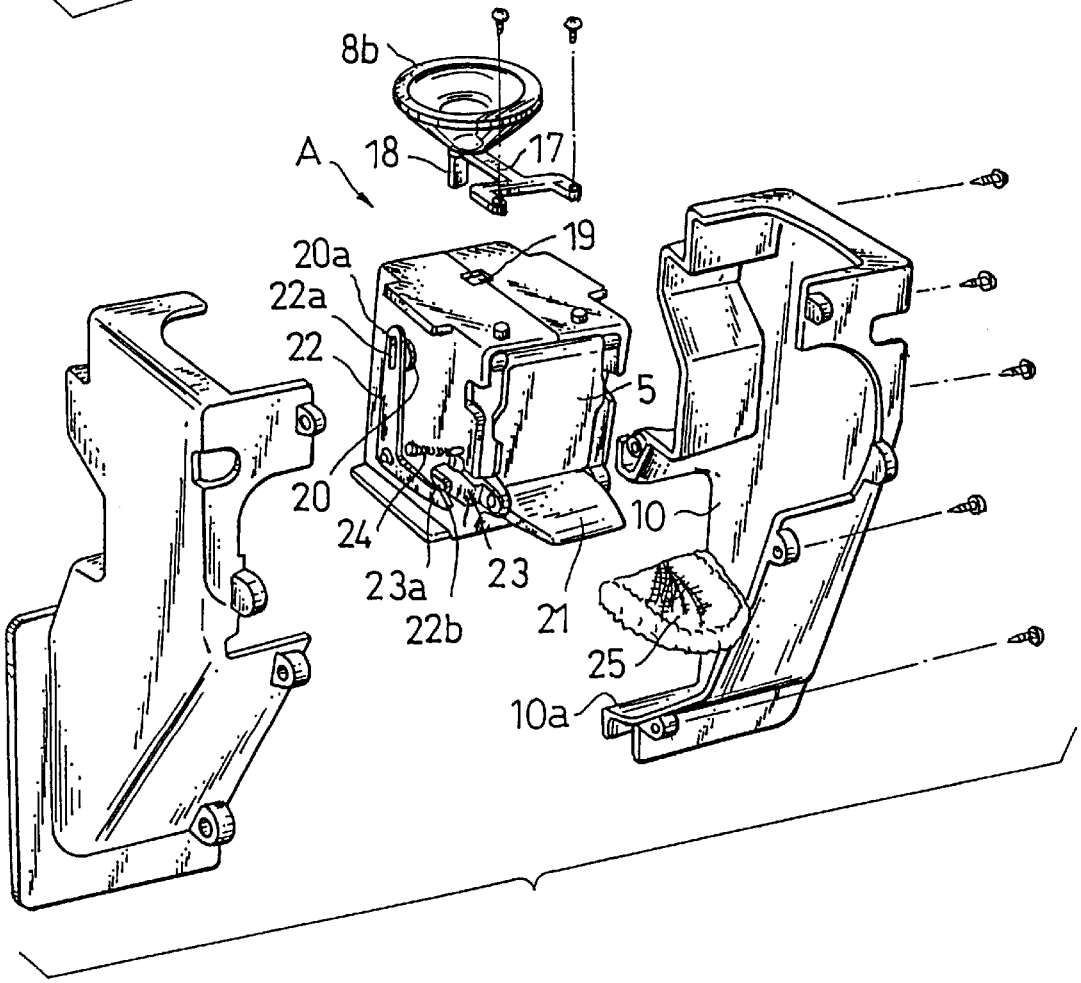

As shown in FIGS. 3A and 3B, the sound output unit A is formed in a front surface thereof with an opening 9, at which the door member 5 formed with a substantially L-shape in section is pivotally supported on the sound output unit A by means of a shaft 11, so that the toy food 3 put in the mouth 4 forcedly presses the door member 5 to pivotally move it about the shaft 11.

The wind-up mechanism 6 for winding up the spiral spring of the spiral spring unit 7 is arranged on the door member 5 as described hereinafter. The wind-up mechanism 6 may be constructed of a plate member of a sector-like shape arranged on a rear surface of the door member 5. The plate member is formed on a peripheral surface thereof with a sector gear 6*a* and actuated in association with rotation of the door member 5 to rotate a wind-up gear 13 as described hereinafter.

The spiral spring unit 7 may comprise any conventional spiral spring unit commonly known in the art which may be securely received in a receiving section 12 defined in the sound output unit A and includes the spiral spring wind-up gear 13 mounted on an input shaft (not shown) and engaged with the sector gear 6*a*, a spiral spring (not shown), an output shaft 14 rotatable in association with a plurality of gears rotated by an unwinding force of the spiral spring and a reduction governor.

Figure 4:
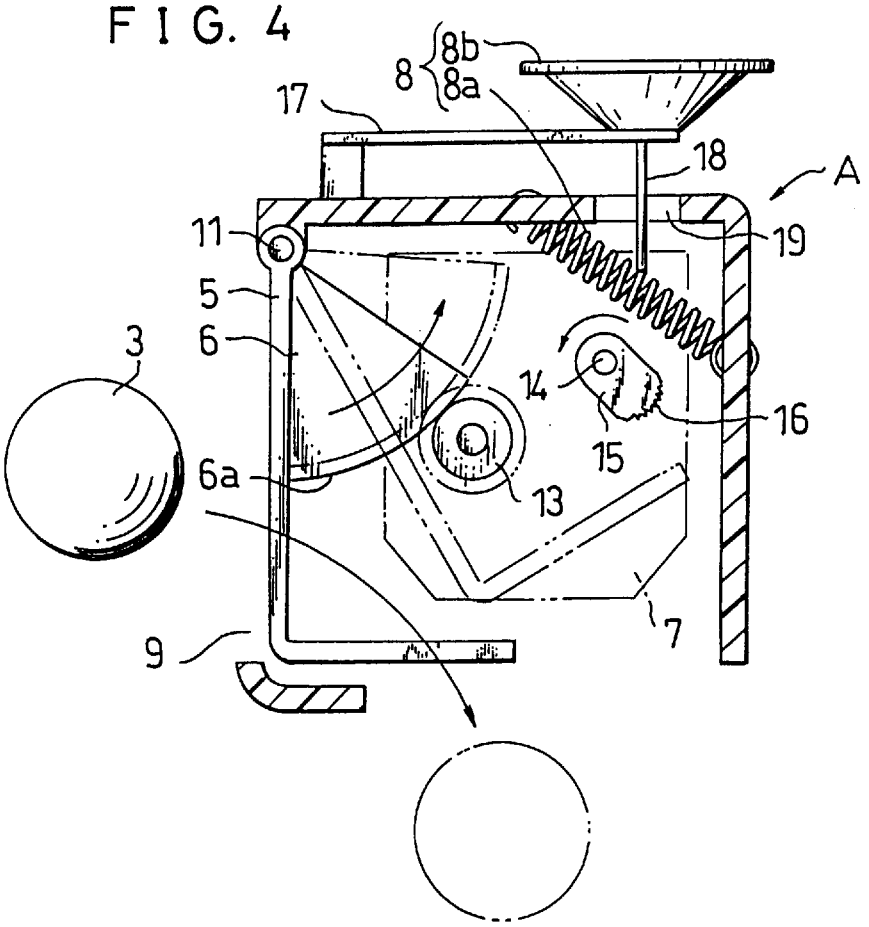
FIG. 4 is a sectional view showing an essential part of the sound generating toy of FIG. 1.

The output shaft 14 is projected at one end thereof from a side surface of the spiral spring unit 7 and mounted on a distal end thereof with an eccentric rotating member 15. The eccentric rotating member 15 is formed on a part of a peripheral surface of a long-diameter section thereof with unevenness or serrated recesses 16 as shown in FIG. 4.

The sound generating means 8 includes the coiled spring 8*a* and speaker 8*b*. The spring 8*a* is stretchedly arranged in the sound output unit A so as to obliquely extend across an upper portion of the unit A and in a manner to be cyclically engaged with the unevenness or serrated recesses 16 of the eccentric rotating member 15 in accordance with rotation of the eccentric rotating member 15. Such engagement between the serrated recesses 16 and the coiled spring 8a causes the recesses 16 to cyclically scratch the spring 8*a*, resulting in a vibrational sound or scratching sound being cyclically generated, so that sound which is an imitation sound impressing as if a little bear bites food with a crunching sound may be cyclically provided.

The speaker 8*b* may comprise a cone member formed of a synthetic resin material such as a plastic material into an inverted conical shape. The cone member 8*b* is mounted on an upper surface of one end of a support member 17. The support member 17 is mounted on a lower surface of the one end thereof with an upper end of a detection element 18, of which a lower end is arranged so as to be in contact with the spring 8*a* while extending via a through-hole 19 formed in an upper wall of the sound output unit A into the sound output unit A. Thus, the detection element 18 acts to transmit the vibrational sound of the spring 8*a* therethrough to the speaker 8*b* or cone member. The support member 17 is securely mounted at the other end thereof on an upper surface of the sound output unit A. Thus, in the illustrated embodiment, it will be noted that the support member 17 is in the form of a cantilevered support member.

Figure 5:
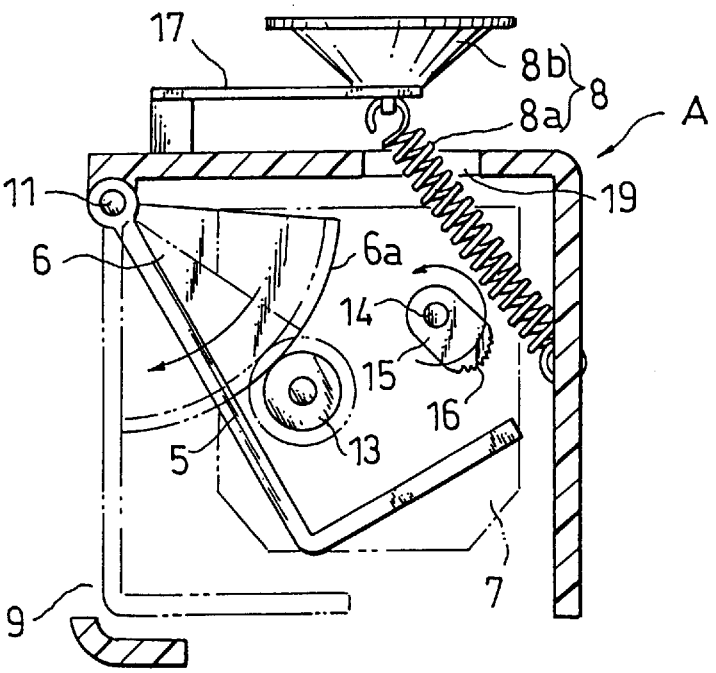
FIG. 5 is a sectional view showing an essential part of another embodiment of a sound generating toy according to the present invention.

The spring 8*a* may be arranged in such a manner as shown in FIG. 5. More particularly, in FIG. 5, the spring 8*a* is arranged so that one end thereof obliquely upwardly extends via the through-hole 19 of the sound output unit A to an exterior of the unit A and then is connected directly to the lower surface of the one end of the support member 17. Such arrangement permits vibrational sound of the spring 8*a* to be more efficiently transmitted to the speaker 8*b*.

In the sound generating toy of the illustrated embodiment constructed as described above, when the toy food 3 formed in imitation of food is pushed into the mouth 4, the door member 5 is forced to be pivotally moved about the shaft 11 as shown in FIG. 4. This permits the spiral spring wind-up mechanism 6 or sector gear 6*a* to be actuated in association with pivotal movement of the door member 5, to thereby rotate the wind-up gear 13 of the spiral spring unit 7, resulting in the spiral spring being wound up. Then, when the toy food 3 is downwardly guided from the sound output unit A through the passage 10, to thereby release the door member 5 from the pressing force, the door member 5 is pivotally moved in an opposite direction by a restoring or unwinding force of the spiral spring, to thereby close the mouth 4 or opening 9 and rotate the eccentric rotating member 15 fixed on the output shaft 14 of the spiral spring unit 7. This results in the serrated recesses 16 of the eccentric rotating member 15 being cyclically engaged with the spring 8*a* and moved relatively to the spring 8*a*, to thereby permit a vibrational sound or scratching sound to be cyclically generated. The vibrational sound thus generated is then transmitted through the detection element 18 to the speaker 8*b*, which amplifies it to generate an imitation sound impressing as if a little bear bites food with a crunching sound.

As described above, in the illustrated embodiment, the spiral spring of the spiral spring unit 7 acting as a power source is wound up by merely inserting the toy food 3 into the mouth 4, so that an unwinding force of the spiral spring actuates the sound generating means 8. Thus, the sound generating toy of the illustrated embodiment generates real sound at any time and anywhere as desired without requiring any sound synthesizing IC or sensor and without using a battery acting as a power supply.

Now, a structure shown in FIGS. 3A and 3B which may be incorporated in the sound generating toy of the illustrated embodiment will be described hereinafter.

The output shaft 14 of the spiral spring unit 7 is securely mounted thereon with an eccentric cam 20, which is engaged with a lever 22 of a substantially L-shape to vertically pivotally move a lower jaw member 21 pivotally provided on a front portion of the sound output unit A. The eccentric cam 20 has an eccentric shaft 20*a* engagedly fitted in an elongated hole 22*a* formed through the substantially L-shaped lever 22. The lever 22 is pivotally supported on a left-hand side surface of the sound output unit A and engaged at a distal end 22*b* thereof with an engagement projection 23*a* formed on an engagement member 23 connected to the lower jaw member 21. The engagement member 23 is urged by a spring 24 so that the lower jaw member 21 may be upwardly pivotally moved.

Reference numeral 25 designates a cover member for covering the lower jaw member 21, which may be made of a fabric in imitation of an outer skin constituting a surface of the sound generating toy.

In the sound generating toy having the structure shown in FIGS. 3A and 3B incorporated therein, when the toy food 3 is put in the mouth 4, the door member 5 is pivotally moved to wind up the spiral spring of the spiral spring unit 7. Then, when the toy food 3 is dropped through the passage 10, an unwinding force of the spiral spring permits the sound generating means 8 to cyclically generate sound and rotates the eccentric cam 20 fixed on the output shaft 14, so that the lever 22 is pivotally moved. Pivotal movement of the lever 22 in a counter-clockwise direction causes the distal end 22*b* of the lever 22 to upwardly push the engagement projection 23*a* of the engagement member 23, so that the lower jaw member 21 is downwardly pivotally moved against the spring 24. Then, pivotal movement of the lever 22 in a clockwise direction causes the distal end 22*b* of the lever 22 is to be downwardly moved, so that the engagement projection 23*a* is released from engagement with the lever 22, whereby the lower jaw member 21 may be upwardly pivotally moved while being urged by the spring 24. Thus, the lower jaw member 21 is vertically pivotally moved in synchronism with sound generation of the sound generating means 8 in accordance with rotation of the output shaft 14. Also, such actuation of the lower jaw member 21 is interrupted in synchronism with interruption of generation of sound.

In the illustrated embodiment, the eccentric rotating member 15 for actuating the sound generating means 8 and the eccentric cam 20 for actuating the lower jaw member 21 are mounted on the same output shaft 14, so that the lower jaw member 21 may be actuated in synchronism with actuation of the sound generating means 8 from beginning to end. Thus, it will be noted that the sound generating toy of the illustrated embodiment exhibits increased reality while being simplified in structure.

Figure 6:
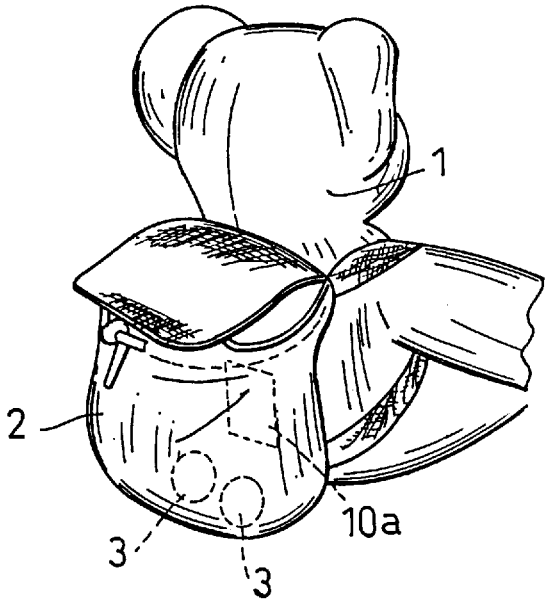
FIG. 6 is a perspective view showing a manner of use of a sound generating toy according to the present invention.

The toy food 3 dropped through the passage 10 is automatically received in the rucksack or receptacle section 2 through the opening 10*a* of the passage 10, so that removal of the toy food 3 from the toy may be carried out through the rucksack 2 as shown in FIG. 6, while avoiding unnatural removal of the toy food 3 with the belly or back of the toy opened. Thus, the toy exhibits more naturalistic properties.

Industrial Applicability

The sound generating toy of the present invention is applicable to a toy animal, a stuffed animal, or the like which needs no electric power source such as a battery or the like.

I claim:

1. A sound generating toy including a toy body provided with a head (1) and a mouth (4) arranged in said head, wherein sound is generated when a toy food is put in said mouth, the sound generating toy comprises:

a door member (5) arranged in said head so as to be moved when a toy food (3) made in imitation of food is put in said mouth;

a spiral spring unit (7) including a spiral spring, an input shaft and an output shaft (14) and arranged in said head;

a wind-up mechanism (6) arranged in said head and actuated in association with said door member to wind up said spiral spring of said spiral spring unit; and a sound generating means (8) arranged in said head for generating sound, wherein said output shaft of said spiral spring unit is mounted thereon with an eccentric rotation member (15), so that rotation of said output shaft causes said eccentric rotation member to engage with said sound generating means to permit said sound generating means to mechanically and cyclically generate a sound.

2. A sound generating toy as defined in claim 1, wherein said toy further comprises a lower jaw member (21) pivotally arranged in said mouth and a lever (22) operatively connected to said lower jaw member to vertically pivotally move said lower jaw member;

said output shaft of said spiral spring unit is mounted thereon with an eccentric cam (20); and said cam is engaged with said lever.

3. A sound generating toy as defined in claim 1, wherein said door member is arranged in a manner to be pivotally movable;

said wind-up mechanism comprises a sector gear (6*a*) provided on said door member;

said input shaft of said spiral spring unit is mounted thereon with a wind-up gear (13); and said sector gear is engaged with said wind-up gear.

4. A sound generating toy as defined in claim 1, wherein said toy body is formed therein with a passage (10) for transferring said toy food therethrough in a manner to extend from said mouth to a rear portion of said toy body;

said passage has an opening (10*a*) formed at said rear portion of said toy body; and said rear portion of said toy body is provided with a receptacle section for covering said opening of said passage and receiving said toy food.

5. A sound generating toy as defined in claim 1, wherein said sound generating means comprises a stretchedly arranged coiled spring (8*a*) and a speaker (8*b*) arranged so as to be in contact with said coiled spring;

said eccentric rotation member is formed on an outer periphery thereof with unevenness (16) engageable with said coiled spring;

said unevenness generates a vibrational sound due to engagement thereof with said coiled spring and movement thereof relative to said coiled spring; and said vibrational sound is transmitted to said speaker, resulting in its being amplified.

6. A sound generating toy as defined in claim 5, wherein said speaker comprises a cone member fixed on a cantilevered support member (17).

7. A sound generating toy as defined in claim 6, wherein said coiled spring is held at one end thereof on said support member.

8. A sound generating toy as defined in claim 6, wherein said speaker includes a detection element (18) arranged on said support member so as to be in contact at one end thereof with an outer surface of said coiled spring.

9. A sound generating toy as defined in claim 4, wherein said toy body has an appearance formed in imitation of an animal; and said receptacle section is formed in imitation of a rucksack.

10. A sound generating toy as defined in claim 2, wherein, said door member is arranged in a manner to be pivotally movable;

said wind-up mechanism comprises a sector gear (6*a*) provided on said door member;

said input shaft of said spiral spring unit is mounted thereon with a wind-up gear (13); and said sector gear is engaged with said wind-up gear.

11. A sound generating toy as defined in claim 2, wherein said toy body is formed therein with a passage (10) for transferring said toy food therethrough in a manner to extend from said mouth to a rear portion of said toy body;

said passage has an opening (10*a*) formed at said rear portion of said toy body; and said rear portion of said toy body is provided with a receptacle section for covering said opening of said passage and receiving said toy food.

12. A sound generating toy as defined in claim 3, wherein said toy body is formed therein with a passage (10) for transferring said toy food therethrough in a manner to extend from said mouth to a rear portion of said toy body;

said passage has an opening (10*a*) formed at said rear portion of said toy body; and said rear portion of said toy body is provided with a receptacle section for covering said opening of said passage and receiving said toy food.

13. A sound generating toy as defined in claim 2, wherein said sound generating means comprises a stretchedly arranged coiled spring (8*a*) and a speaker (8*b*) arranged so as to be in contact with said coiled spring;

said eccentric rotation member is formed on an outer periphery thereof with unevenness (16) engageable with said coiled spring;

said unevenness generates a vibrational sound due to engagement thereof with said coiled spring and movement thereof relative to said coiled spring; and said vibrational sound is transmitted to said speaker, resulting in its being amplified.

14. A sound generating toy as defined in claim 3, wherein said sound generating means comprises a stretchedly arranged coiled spring (8*a*) and a speaker (8*b*) arranged so as to be in contact with said coiled spring;

said eccentric rotation member is formed on an outer periphery thereof with unevenness (16) engageable with said coiled spring;

said unevenness generates a vibrational sound due to engagement thereof with said coiled spring and movement thereof relative to said coiled spring; and said vibrational sound is transmitted to said speaker, resulting in its being amplified.

15. A sound generating toy as defined in claim 4, wherein said sound generating means comprises a stretchedly arranged coiled spring (8*a*) and a speaker (8*b*) arranged so as to be in contact with said coiled spring;

said eccentric rotation member is formed on an outer periphery thereof with unevenness (16) engageable with said coiled spring;

said unevenness generates a vibrational sound due to engagement thereof with said coiled spring and movement thereof relative to said coiled spring; and said vibrational sound is transmitted to said speaker, resulting in its being amplified.

16. A sound generating toy as defined in claim 5, wherein said toy body has an appearance formed in imitation of an animal; and said receptacle section is formed in imitation of a rucksack.

17. A sound generating toy as defined in claim 6, wherein said toy body has an appearance formed in imitation of an animal; and said receptacle section is formed in imitation of a rucksack.

18. A sound generating toy as defined in claim 7, wherein said toy body has an appearance formed in imitation of an animal; and said receptacle section is formed in imitation of a rucksack.

19. A sound generating toy as defined in claim 8, wherein said toy body has an appearance formed in imitation of an animal; and said receptacle section is formed in imitation of a rucksack.

20. A sound generating unit that can be incorporated in a toy to generate the simulated sound of eating food comprising:

a housing member;

a movable member connected to the housing member that can be positioned in a toy to be activated when the toy receives simulated food;

a mechanical spring storage mechanism connected to the movable member for storing energy when the movable member is activated and for releasing the energy over a predetermined time period;

a rotatable member operatively connected to the spring storage mechanism and rotatable when energy is released, the rotatable member including a serrated surface;

a coil spring;

a speaker, operatively connected to the coil spring for receiving mechanical vibrations from the coil spring to produce sound, the coil spring mounted in the housing member to contact the serrated surface of the rotatable member.

* * * * *